US011519591B2

(12) United States Patent
Marie et al.

(10) Patent No.: US 11,519,591 B2
(45) Date of Patent: Dec. 6, 2022

(54) HEADLAMP COMPRISING IMPROVED DYNAMIC LIGHTING

(71) Applicant: Zedel, Crolles (FR)

(72) Inventors: Christophe M. Marie, Benin (FR); Nicolas M. Beaurent, La Pierre (FR)

(73) Assignee: Zedel, Crolles (FR)

( * ) Notice: Subject to any disclaimer, the term of this patent is extended or adjusted under 35 U.S.C. 154(b) by 0 days.

(21) Appl. No.: 17/703,478

(22) Filed: Mar. 24, 2022

(65) Prior Publication Data

US 2022/0307678 A1 Sep. 29, 2022

(30) Foreign Application Priority Data

Mar. 25, 2021 (EP) ..... 21164886

(51) Int. Cl.

| | |
|---|---|
| ***F21V 23/04*** | (2006.01) |
| ***G08B 21/04*** | (2006.01) |
| ***F21L 4/00*** | (2006.01) |
| ***F21V 21/084*** | (2006.01) |
| ***F21V 23/00*** | (2015.01) |
| ***F21Y 115/10*** | (2016.01) |
| ***G08B 5/22*** | (2006.01) |

(52) U.S. Cl.

CPC ..... *F21V 23/0492* (2013.01); *F21L 4/00* (2013.01); *F21V 21/084* (2013.01); *F21V 23/003* (2013.01); *G08B 21/043* (2013.01); *F21Y 2115/10* (2016.08); *G08B 5/22* (2013.01)

(58) Field of Classification Search

CPC ..... F21L 4/00; F21V 21/084; F21V 23/003–0492; F21Y 2115/10; G08B 5/22; G08B 21/0407–043

See application file for complete search history.

(56) References Cited

U.S. PATENT DOCUMENTS

| | | | | |
|---|---|---|---|---|
| 10,178,743 | B2 * | 1/2019 | Bortolotti | F21V 14/003 |
| 2016/0258599 | A1 | 9/2016 | Genthon | |
| 2020/0187331 | A1 | 6/2020 | Bertken et al. | |

FOREIGN PATENT DOCUMENTS

| | | | |
|---|---|---|---|
| WO | 2012/146256 | A2 | 11/2012 |

OTHER PUBLICATIONS

European Search Report, Reference: ZED22ep2, Application No. 21 164 886.0, Applicant: Zedel, dated Jul. 23, 2021, 12 pages.

* cited by examiner

*Primary Examiner* — Jason M Han

(74) *Attorney, Agent, or Firm* — Saile Ackerman LLC; Stephen B. Ackerman

(57) ABSTRACT

A headlamp with a light source, a power module to generate power for the light source from control information or a control signal, a control module for adjusting the power generated by the light source. The control module has a light sensor for sensing light from the environment of the lamp holder. The control module generates control information according to the information generated by the light sensor. The control module has an accelerometer to provide at regular intervals data representative of an acceleration of the headlamp along at least one horizontal axis and one vertical axis. The control module stores and processes accelerometry data. The control module includes a LUT lookup table stored in memory. The parameter read from the LUT lookup table is used in conjunction with information generated by the light sensor to determine the light output control information or signal.

11 Claims, 7 Drawing Sheets

HEADLAMP COMPRISING IMPROVED DYNAMIC LIGHTING

TECHNICAL FIELD

The present invention relates to the field of headlamps based on a technique of so-called Reactive Lighting and in particular a headlamp comprising an accelerometric sensor.

BACKGROUND

The applicant of the present patent application has marketed a portable lamp, of the headlamp type, equipped with so-called reactive or dynamic lighting, the operating principle of which is illustrated in FIG. 1. This headlamp comprises an electronic circuit equipped with a sensor that analyzes the brightness outside to instantly deliver the adjusted lighting power and optimal beam shape for the situation.

This type of headlamp has proven to be particularly suitable for sport activities and particularly intensive sports because it relieves the user of the manual mode adjustments that would be necessary to switch between different beam power thresholds.

Thanks to this reactive lighting technique, the user has his hands free and his mind totally focused on his activity, whatever the lighting situation considered.

Thus, in proximity lighting, the user can thus observe or examine an object at a short distance (reading a map, making a tie-up knot or setting up a tent for example) and the lamp can generate a very wide and low-power light beam, automatically set to a minimum threshold value thanks to this dynamic lighting technique. The lighting automatically adapts to the distance of the object.

On the contrary, in a situation of movement, for example when the user engages in walking and/or running, the beam becomes mixed: wide at the level of the feet and focused to see at a few meters and anticipate the ground relief.

In addition, when in a situation of distant vision, the user raises his head to see far away—for example to look for a beacon during a run or even a relay attached to a climbing wall, the power of lighting increases dramatically and the beam becomes focused to best assist the lamp user.

Finally, we note that the reactive or dynamic lighting technology (Reactive Lighting) has proved to be particularly economical in use and makes it possible to advantageously increase the autonomy of the batteries since its implementation, under the control of a calculator, aims to optimize battery consumption, offering greater autonomy for your lamp.

As we can see, this reactive or dynamic lighting technology is undeniably a significant advance in the field of headlamps, and more generally of portable lighting, in particular in that it allows the lighting to be constantly adapted to fit lighting conditions.

However, practitioners have identified drawbacks in certain very specific situations.

In fact, in so-called trail running or running activities, the presence of many reflective surfaces on shoes, technical clothing and signs cause pumping phenomena in the level of the projected light, thus degrading the quality of the lighting and revealing an area of discomfort for the user.

When the latter is cycling with his headlamp, or even other very dynamic activities (ski touring or other), the minimum level of light might practically show to be insufficient to guarantee safe conditions of lighting when crossing with a luminous or natural obstacle (car headlights, tree branch, etc.). The area of discomfort noted previously may then turn out to be a danger zone.

SUMMARY OF THE INVENTION

The above defects and disadvantages are remedied in the present invention.

The purpose of the present invention is to propose a significant improvement to dynamic lighting technology by making it possible to take into consideration specific lighting situations requiring additional lighting.

Another object of the present invention consists in proposing a headlamp fitted with a lighting regulation of the type reactive or dynamic and which has improved adjustment of the light power.

It is another object of the present invention to provide a headlamp improved by the addition of an accelerometer which refines the reactive or dynamic regulation mechanism used by the lamp.

The invention achieves these goals by means of a lamp, such as a headlamp, comprising

- a light source;
- a power module for supplying power to the light source in accordance with a control information or a control signal;
- a control module for adjusting the power of light generated by the light source, comprising:

a light sensor for sensing light from the environment of the holder of the lamp, the control module being configured to generate the control information or the control signal according to the information generated by the light sensor.

The control module further comprises an accelerometer configured to supply at regular intervals data representative of an acceleration of the headlamp along at least one horizontal axis and one vertical axis; and wherein the control module includes circuitry configured to store and process accelerometry data to determine a physical activity selected among a set of different predetermined physical activity profiles stored within a memory.

The profile of the physical activity which is selected is then used as an input value for reading a look-up table LUT stored within a memory internal to the headlamp and which provides at least one value or one parameter used for generating the control information or the control signal controlling the lighting power. So that the value or the parameter which is read within the look-up table is used jointly with the information generated by the lighting sensor for determining the control information or the control signal controlling the light power.

Preferably, the set of predetermined accelerometric profiles comprises profiles which are representative of the walking, the running and bicycle riding.

Preferably, the power of the light beam set by the control unit varies between two threshold values, respectively low and high, and the low threshold is set by a value which is extracted directly from the LUT look-up table from the automatically selected profile.

Preferably, the processing of the accelerometry data allowing the selection of the predetermined profile uses a statistical processing method based on a calculation of the variance of the accelerometry data along the two horizontal axes and along the vertical axis.

In a particular embodiment, the data extracted from the LUT table make it possible to define a minimum light power threshold and a specific geometry of the light beam chosen between a wide beam, a focused narrower beam and/or both.

Preferably, the light is a headlamp configured to process accelerometer data to detect a user's fall in addition to his/her physical activity and configured to communicate with a mobile phone for the purpose of transmitting a message of alert.

In a particular embodiment, in the event of a fall, the control module is configured to control a light alert sequence aimed at calling for help.

BRIEF DESCRIPTION OF THE DRAWINGS

Other characteristics, object and advantages of the invention will appear on reading the description and the drawings below, given solely by way of non-limiting examples. On the attached drawings.

DESCRIPTION

We now describe how it is possible to significantly improve a headlamp equipped with a reactive or dynamic lighting system, such as marketed in the "RL" lamps of the company PETZL, for example the headlamps marketed under the called NAO™, or SWIFT RL™, and which include an automatic mechanism for regulating the power generated based on information produced by a light sensor.

Thanks to the present invention, the mechanism for regulating the light power is arranged so as to integrate, in addition to the information emanating from the luminosity sensor, other additional information generated by an accelerometric sensor supplying acceleration signals on one or more X1, Y1 or Z1 axes.

A specific algorithm, which will be described in detail below, makes it possible to set lighting thresholds generated by the light power regulation system, and in particular a minimum lighting threshold.

I. General Architecture

Figure 1:
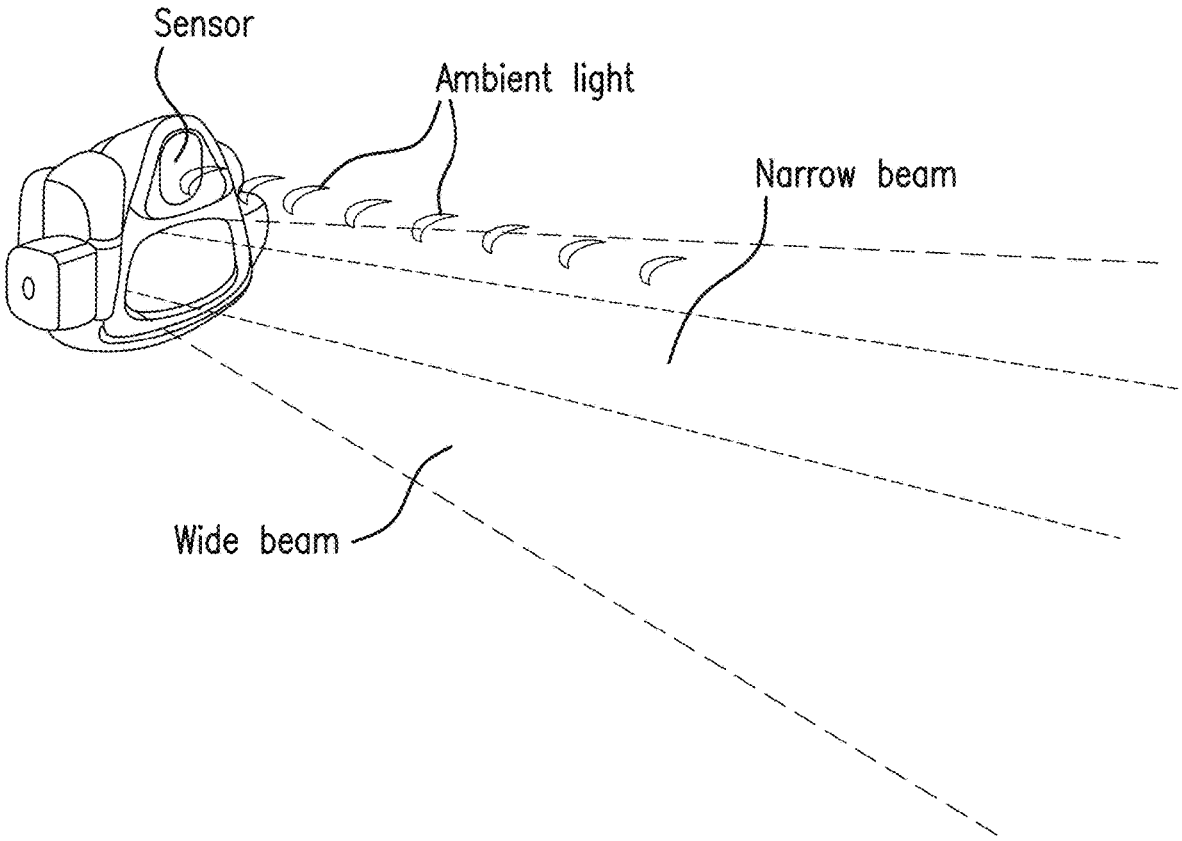
FIG. 1 represents an embodiment of a headlamp in accordance with the present invention, which incorporates a luminosity sensor as well as an accelerometric sensor to set the reactive or dynamic lighting thresholds.
Figure 2:
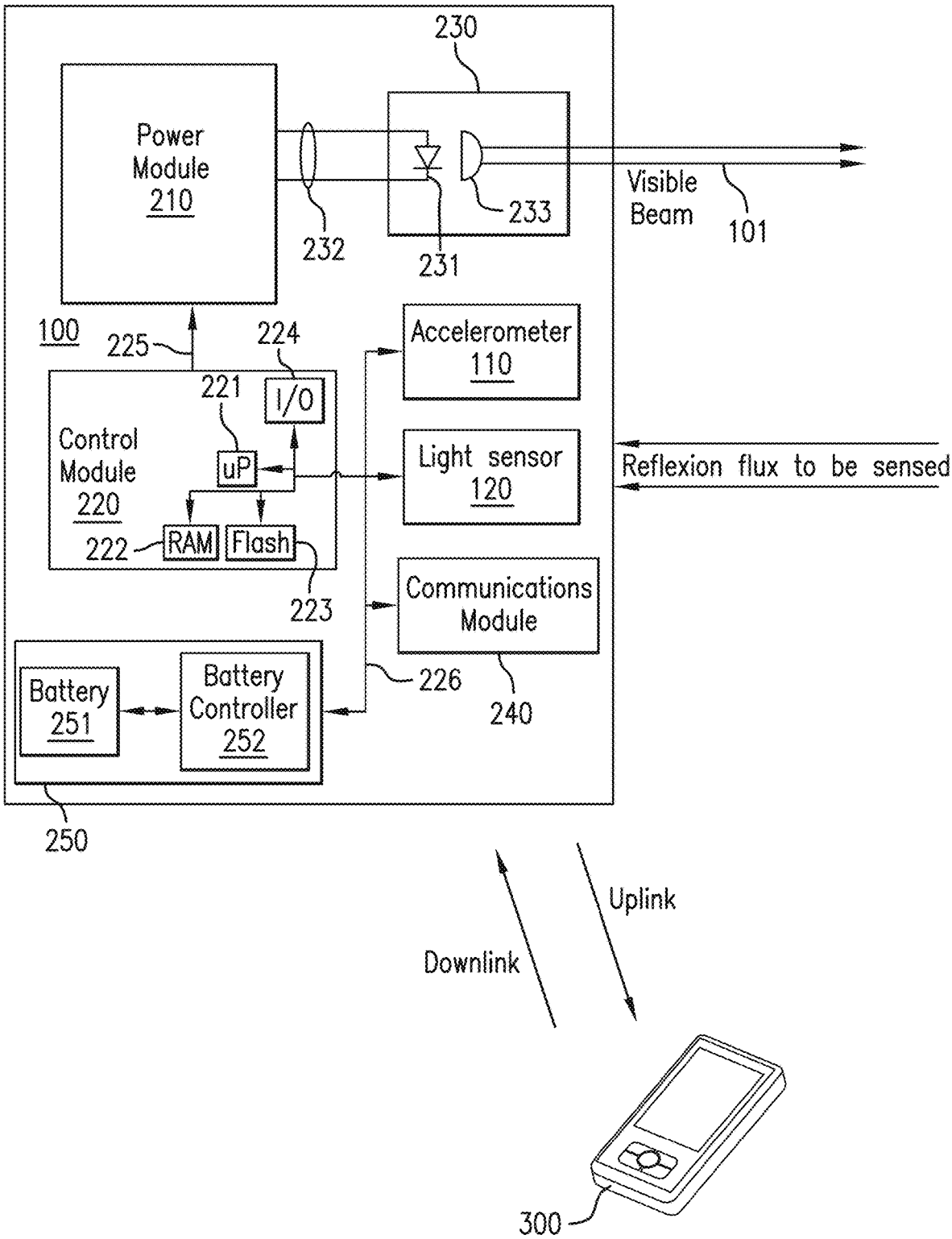
FIG. 2 illustrates the block diagram of dynamic or reactive lighting.

FIG. 2 illustrates the general architecture of an embodiment of a lamp 100—assumed to be a headlamp—comprising a reactive or dynamic light intensity regulation system based on a sensor 120 making it possible to measure the ambient luminosity and/or part of the flux reflected by the illumination of the headlamp.

The lamp 100 also comprises an accelerometric sensor, and preferably a three-dimensional (3D) acceleration sensor 110 making it possible to generate accelerometric information along at least one axis and preferably three axes X1, Y1, Z1 particularly illustrated in FIGS. 8*a*-8*d*, the axes X1 and Z1 being horizontal and the axis Y1 being vertical.

More specifically, the lamp 100 comprises a power module 210 associated with a control module 220 and a lighting unit 230 comprising at least one light-emitting diode LED and, optionally, a communications module (transmitter-receiver module) 240 coupled to the control module 220 and a battery module 250 also coupled to control module 220.

In the example of FIG. 2, the lighting unit 230 comprises a single LED diode 231 equipped with its power supply circuit 232 connected to the power module 210. Clearly, several diodes could be envisaged for obtaining a beam of strong light. In general, the LED diode(s) can be associated with its own focal optics 233 making it possible to ensure collimation of the generated light beam.

In a specific embodiment, diode LEDs 231 is powered by power module 210 via circuit 232, under the control of a control information or a control signal generated by the control module 220 via a link which may take the form of a control wire or, alternatively, a set of wires forming a control bus. The figure shows more specifically the particular example of a control lead 225.

The power module 210 specifically comprises all the components that are conventionally encountered in an LED lighting lamp for the production of a high intensity light beam, and in general based on Pulse Width Modulation PWM, well known to a person skilled in the art and similar to that encountered in class D audio circuits. This PWM modulation is controlled by means of the control signal generated by the control module 220 via a control lead 225. In general, it will be noted that the term "signal" mentioned above refers to an electrical quantity—current or voltage—making it possible to cause the control of the power module, and in particular the PWM modulation used to supply the LED diode 231 with current. This is only a particular embodiment, it being understood that it will be possible to substitute for the "control signal 225" any "control information", for example a logic information stored within a register and as mentioned above, transmitted to power module by any suitable means so as to control the power of the light beam. The control signal can therefore be transmitted on different media depending on whether it is a control signal or a control information. These supports can be a bus-type communication line coupling the control module and the power module or a simple electronic circuit for transferring a control voltage or current. In a particular embodiment, it will even be possible to envisage the two control and power modules being integrated into the same module or integrated circuit.

A person skilled in the art will therefore easily understand that when one refers to a "control signal", one encompasses indiscriminately the realizations using an electrical control quantity—current or voltage—as well as the realizations in which the control is carried out by means of logic information transmitted within the power circuit. For this reason, reference will be made hereinafter indistinctly to a control signal or a control information.

In general, the components that make up the power module 210—switches and circuits—are well known to a person skilled in the art and the description will be deliberately lightened in this respect for the sake of conciseness.

Similarly, the reader will be referred to general works dealing with the various aspects of PWM modulation.

Returning to FIG. 2, it can be seen that the control module 220 comprises a processor 221 as well as volatile memories 222 of the RAM type and non-volatile (flash, EEPROM) 223 as well as one or more input/output circuits 224. RAM memory and non-volatile memories are for storing data and firmware or firmware instructions. Furthermore, the non-volatile memory 223 is also used to store data representative of physical activity profiles which will be used in conjunction with the accelerometer data provided by the accelerometric sensor 110 as will be described later.

The headlamp also comprises a battery module 250 having a controller 252 and a battery 251 for example of the Ion-Lithium type.

In general, the control module 220 can access each of the other modules present in the lamp, and in particular the power module 210, the battery module 250, the two brightness 120 and accelerometer 110 sensors as well as, if applicable, to the communication module 240 allowing two-way (uplink and downlink) wireless communication with a smart phone 300 or any other wireless communication device.

The access of the control module 220 to the various components of the headlamp may take various forms, either by means of specific circuits and/or conductors or a set of conductors forming a bus. By way of illustration, the control lead 225 is represented in FIG. 2 in the form of a conductor while a real data/address/command bus 226 is used for the exchange of information between the control module 220, the battery module 250 and the communication module 240. However, this is only a particular embodiment, it being understood that a person skilled in the art may make various modifications and/or adaptations if necessary to take into account the specific requirements of the intended application.

By accessing the various modules making up the headlamp, the control module 220 can both read and collect information contained in each of these modules and/or conversely, transfer information, data and/or commands thereto, such as this will come out more clearly in the remainder of the presentation.

This is how the control module 220 can forward to the power module 210 a control signal as represented by the signal transmitted on control lead 225 and, more generally, can read the current value of the supply current of the diode 231 transiting via the power supply circuit 232 (via conductors and/or buses not shown in the figure).

Similarly, control module 220 can access the battery module 250 via the bus 226 to read there either the different voltage values (depending on the charge or discharge cycle in progress) at the terminals thereof and/or the value the intensity delivered in order to be able to calculate a State of Charge (SOC in the Anglo-Saxon literature).

II. Communication Module 240

The control module 220 is coupled to a communication module 240 allowing a two-way wireless link with a mobile information processing system or mobile telephone 300. In a preferred embodiment, the transmitter as well as the receiver will be compatible with the Bluetooth standard, preferably with the Bluetooth 4.0 Low energy standard. In another embodiment, the WIFI or IEEE802.11 standard will be adopted instead. The module 240 comprises a baseband unit (not shown) coupled to a wireless receiver and wireless transmitter, making it possible to arrange an uplink communication channel to the mobile telephone 300 and, conversely, a downlink communication channel to this same phone. To this end, the communication module 240 may be required to perform various processing operations, in series or in parallel, on the digital representation of the data signal being received and transmitted, and in particular, operations of filtering, statistical calculation, demodulation, channel coding/decoding making it possible to make the communication robust to noise, etc. Such operations are well known in the field of signal processing, in particular when it is a question of isolating a particular component of a signal, likely to carry digital information, and it will not be necessary here to weigh down the presentation of the description.

Once detected, these packets are forwarded to processor 221 within control module 220.

The processor 221 is therefore responsible for interpreting the received packets as well as formatting the packets to be transmitted according to a format specific to the standard used. Thus, in the case of the Bluetooth Low Energy standard, these packets will have a structure around the standardized Generic Attribute Profile (GATT) that we will not detail here. Depending on the interpretation of the data bits included in the packets received, the processor will reconstruct any information or commands received on the downlink from the mobile information processing system 300. Having interpreted this information or commands, the processor 221 will then relay or convert this information or command to the module concerned. Thus, in the basic embodiment, the processor 221 identifies commands to the attention of the power module 210 in order to modify the light intensity and in reaction to this identification is capable of generating control information conveyed on control lead 225 to destination of the power module 210 so that the latter proceeds to modify the light intensity generated by the lighting unit 230.

In addition, processor 221 is configured to also identify read requests from associated mobile information processing system 300 in order for the headlamp to forward via the uplink certain parameters or data to telephone 300.

These requests can thus be a request for the state of charge of the battery or the value of the current light power. In this case, the processor 221 will retrieve the necessary information directly from the module concerned and after having carried out any additional calculations on this information to obtain the final required information (in the case of the state of charge for example as we see above), will format a corresponding data packet for transmission by the communication module 240.

It is clear that FIG. 2 describes a basic embodiment, and that many other embodiments are possible and within the scope of a person skilled in the art. For example, in a more sophisticated mode, other modules can be added within the headlamp and these modules will also be coupled to processor 221 via bus 226 for example. These modules can then also exchange uplink or downlink data or commands with the associated mobile information processing system 300 which can then communicate with the headlamp and transmit various configuration commands to it by means of a dedicated application running within the smart phone. This dedicated application then makes it possible to coordinate the various functionalities of the headlamp by notably offering a user-friendly interface by means of which the latter can either enter operating parameters or come directly to control the headlamp or select different options to the features offered.

III. Dynamic or Reactive Lighting Control

The control module 220 of the headlamp 100 implements a dynamic or reactive lighting technique. This technique consists of replacing the well-known manual adjustment modes—based on various pre-adjusted light power values such as low, medium or high, with a more automatic technique making it possible to leave the adjustment of the light power to the control module 220 and more specifically to a regulation algorithm executed by the processor 221 under the control of a regulation firmware stored in non-volatile memory 223.

According to the principle of dynamic or reactive lighting, the processor 221 adjusts the light power according to the value of the ambient luminosity measured by the sensor 120, for example by selecting a value chosen from a set of N predefined threshold values. Such a regulation mechanism is therefore similar to an adjustment mechanism by discrete steps within a finite set of power values, allowing the control module 220 to control the headlamp by passing successively from an adjustment value to another value chosen from the set of predetermined values.

With a set of three predetermined adjustment values, corresponding to three powers, for example "low", "medium" or "high", the reactive or dynamic brightness mechanism therefore allows automatic adjustment of the headlamp to the correct value at within the N predetermined values.

In the same way, the geometry of the light beam can be adjusted automatically by the selection, via the control module 220, of a diffusion mode chosen from a set of several predetermined modes: for example, wide, narrow, or both in same time.

Such dynamic or reactive regulation, by discrete steps, turns out to be simple and inexpensive to implement and allows automatic switching between predefined threshold values.

However, a person skilled in the art may consider a more sophisticated regulation mechanism based on a true servo-control loop integrating the value of the luminosity within a feedback loop which may or may not be linear, in order to set the power of the light beam generated by the lighting unit 230. In this respect, error correction mechanisms could be conveniently integrated within the feedback loop, in particular a proportional (P), proportional-integral (PI) correction, or even Proportional Integral Differential (PID) etc . . . , used with suitable parameters.

Whatever the type of light regulation envisaged, by discrete steps or by means of a linear or non-linear servo-control, the regulation of the dynamic or reactive lighting could be advantageously improved by introducing an exploitation of the accelerometer data μx, μy and μz generated by the three-dimensional accelerometric sensor 110, as will now be described.

IV. Collaboration of the Accelerometer 110 with the Dynamic Light Regulation Mechanism The three-dimensional accelerometer module 110 provides accelerometer signals μx, μy and μz along three trigonometric axes X1, Y1 and Z1. As shown in FIG. 8, the X1 and Z1 axes are horizontal while the Y1 axis is a vertical axis and, moreover, the X1 and Y1 axes are arranged in a sagittal plane relative to the user.

Figure 3A:
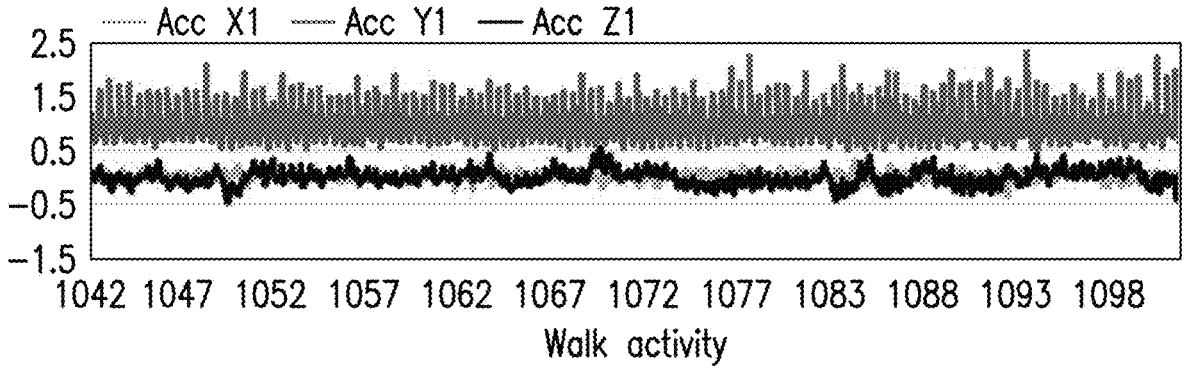
FIGS. 3A to 3C illustrate the typical chronograms, on the three axes x, y and z, of the accelerometric signals for three physical activities considered: walking, cycling and running (jogging).

FIG. 3A illustrates typical timing diagrams of the signals μx, μy and μz for a walking physical activity.

Figure 3B:
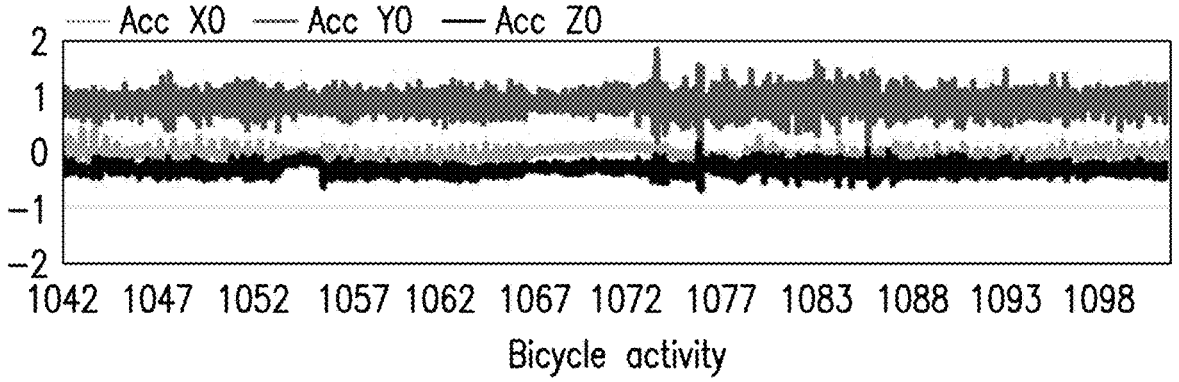

FIG. 3B illustrates typical timing diagrams of the same μx, μy, and μz signals for a bicycle physical activity.

Figure 3C:
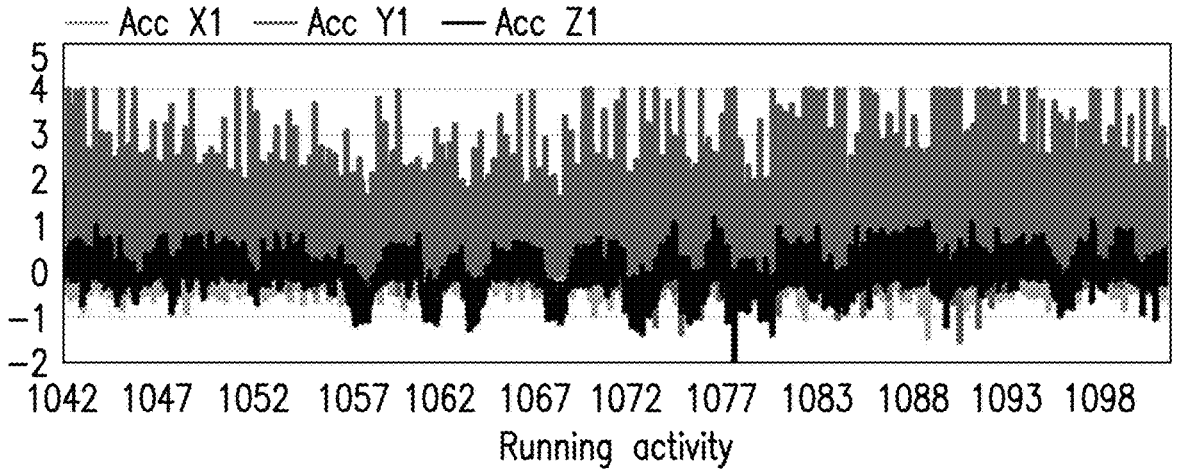

Finally, FIG. 3C illustrates typical chronograms of the signals μx, μy and μz for a physical activity of running.

Figure 4A:
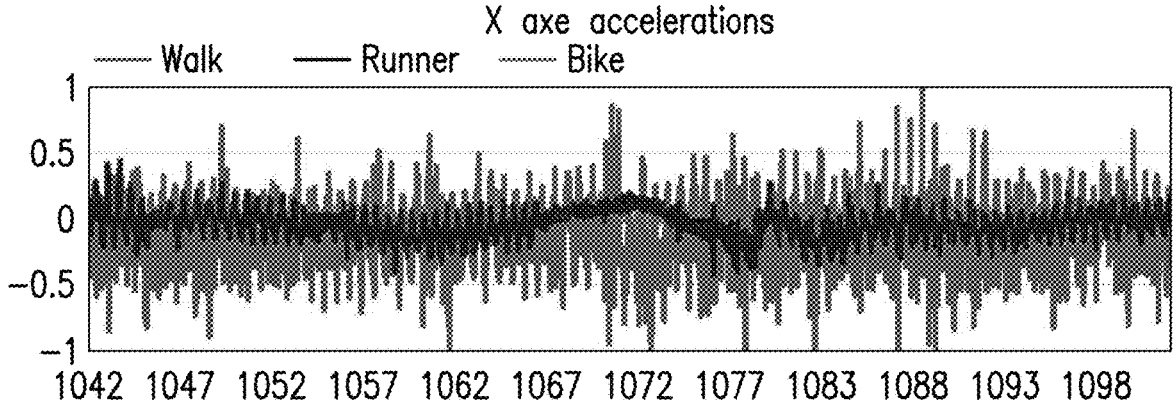
FIGS. 4A, 4B and 4C more particularly illustrate the accelerations along each of the axes xx', yy' and zz' and this for each of the three physical activities considered in one embodiment.
Figure 4B:
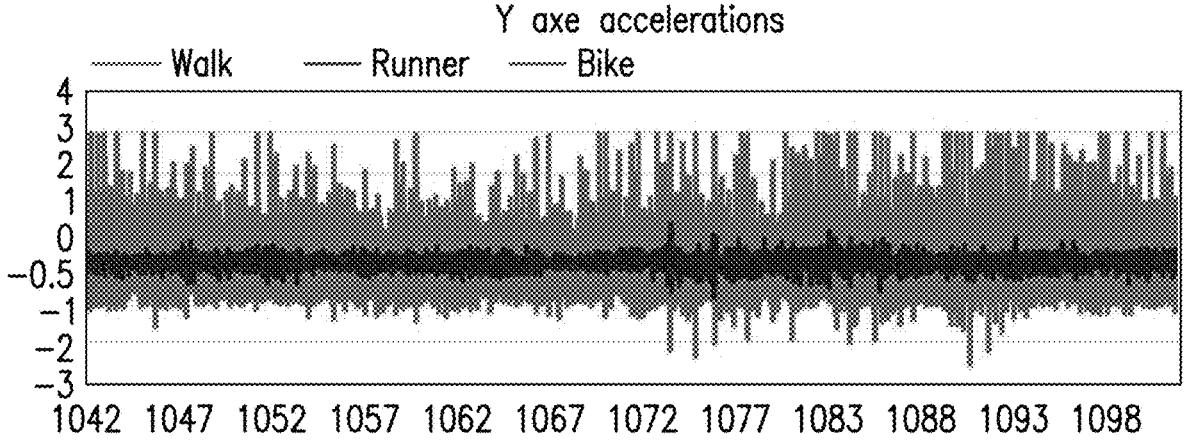
Figure 4C:
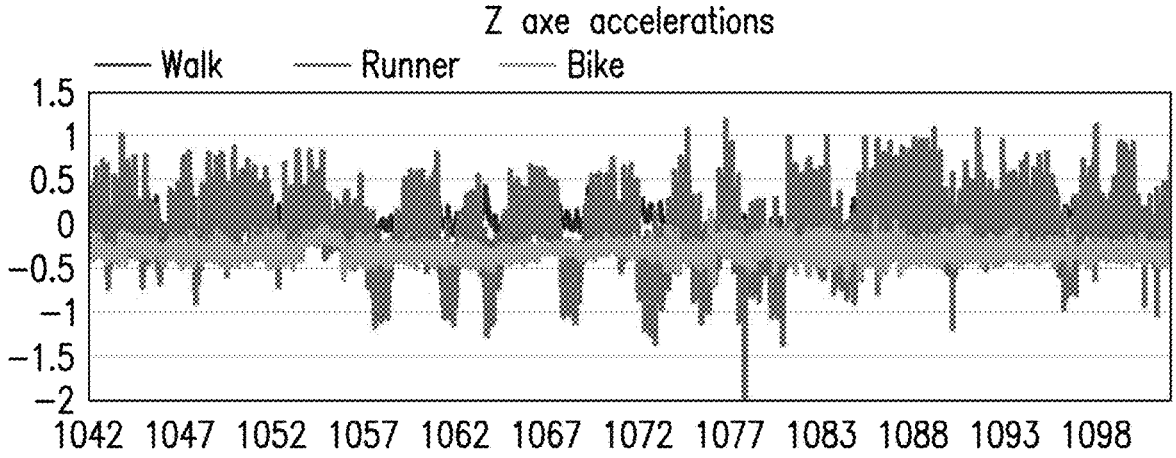

FIG. 4A illustrates more particularly the profile of the acceleration μx, while FIGS. 4B and 4C illustrate the profiles of the accelerations μy and μz, respectively.

As can be seen in these figures, the profiles of these accelerations μx, μy and μz are very characteristic and are clearly distinguished according to the three physical activities considered: Walking; bicycle or bike; running or jogging.

In order to significantly improve the reactive or dynamic regulation mechanism, the headlamp control module 100 is configured to execute a method of detecting a physical activity profile, detected within a set of N profiles predetermined.

Figure 5:
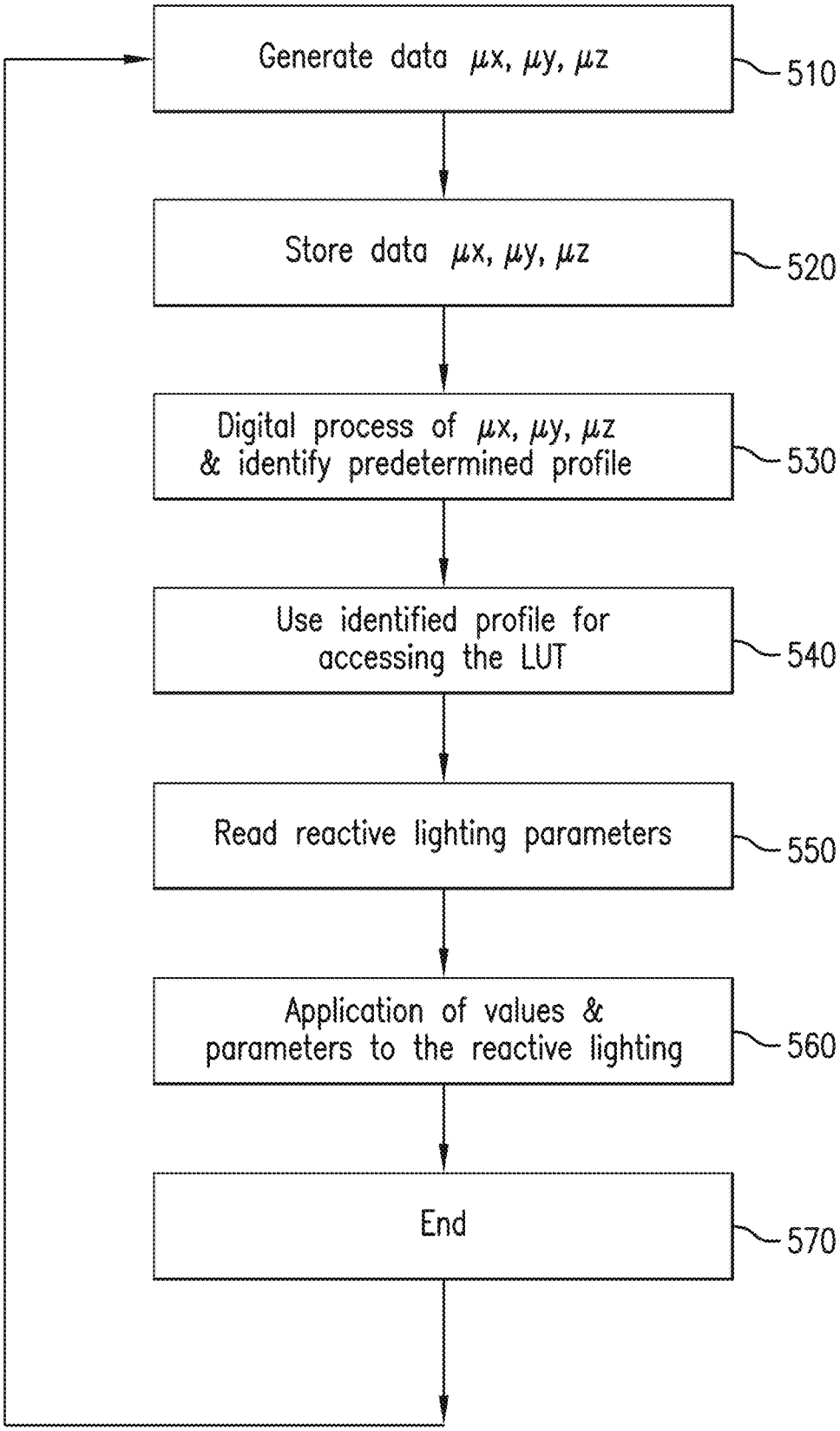
FIG. 5 illustrates an embodiment of a process for controlling the lighting power according to the present invention.

In this respect, the control module 220 is configured in such a way that the non-volatile memory 223 comprises a memory area in which is stored data representative of several physical activity profiles, and preferably the data representative of the activities "walking", "running" and "cycling". Furthermore, the non-volatile memory 223 also comprises an area dedicated for the storage of a micro-program allowing the processing of the accelerometer data μx, μy and μz generated on the fly by the 3D accelerometric sensor 110. This algorithm goes, as it will be detailed later in relation to FIG. 5, comparing the data μx, μy and μz generated in real time with data stored in memory 223 which are characteristic of the predetermined profiles (walking, cycling, running) stored in the memory. The algorithm aims to compare, at regular intervals, the accelerometer data with data representative of a predetermined profile so as to identify a predefined physical activity category, i.e. that corresponding to the different profiles stored in the memory of the headlamp.

FIG. 5 illustrates a method of light regulation in accordance with the present invention, based jointly on the detection of the ambient light from the exploitation of accelerometer data.

In a step 510, the method generates at regular intervals, for example every 20 milliseconds, a set of accelerometer data μx, μy and μz generated by the 3D accelerometric sensor 110. Optionally, the method may be limited to only part of the accelerometer data, for example the single datum μy along the vertical direction Y1.

In a step 520, the method performs the storage of the data μx, μy and μz within the random-access memory RAM 222.

Then, in a step 530, the accelerometer data μx, μy and μz are the subject of digital processing making it possible to identify and select a physical activity profile within a set of N predetermined profiles stored in non-volatile memory 223. Several methods can be used to carry out the selection or detection of the physical activity profile and will be described in more detail in section V of the present description.

In a step 540, the method uses the profile selected in step 530 as an input pointer to access a Look-Up Table (LUT) in which are stored values and parameters specific to the regulation mechanism dynamic or reactive applied by the control module 220 of the headlamp 100, and allowing the generation of the control information or the control signal transmitted to the power module 210.

In a particular embodiment, the parameters read within the Look-Up table LUT correspond to threshold values loaded into registers used by the reactive or dynamic regulation algorithm.

More specifically, the parameters are reduced to a threshold value corresponding to a minimum of lighting considered by the dynamic regulation algorithm.

Alternatively, in the case where the dynamic regulation algorithm uses a set of distinct registers in which are stored threshold values corresponding to various luminosity values, the reading of the correspondence table makes it possible to provide these threshold values. Thus, according to the accelerometric data μx, μy and μz generated by sensor 110 and processed by processor 221, the minimum value and possibly also the maximum value of the luminosity can be defined.

As will be understood, a person skilled in the art will be able to conceive various variants in the use of the values extracted from the correspondence table. It should be noted that these values may be used to set more general parameters than thresholds, and in particular variables used in automatic linear or non-linear regulation mechanisms, for example integral correction parameters or variables, or proportional—integral etc., in order to more finely adapt the reactive or dynamic regulation mechanism to the physical activity profile detected.

Then in a step 550, the method reads the LUT table and extracts the parameter(s) stored therein and, in the case of the preferred embodiment which is particularly economical to implement, the method extracts the minimum threshold value that should be applied to the reactive or dynamic light regulation mechanism.

In a step 560, the reactive or dynamic light regulation mechanism is executed by using the value(s) extracted from the LUT table so as to precisely adapt this regulation, and if necessary the feedback loop used for controlling the light power generated by the headlamp so as to adapt it to the physical activity identified in step 530. Thus the control information or the control signal transmitted via the control lead 225 is generated from the value or values extracted from the LUT, together with the information provided by the light sensor 120.

In the preferred embodiment based on the reading of a single minimum threshold value within the LUT table, the dynamic or reactive regulation is therefore applied so as to ensure, in all cases, a minimum light power corresponding to the threshold value extracted from the LUT table.

It should be noted that various variants may be envisaged by a person skilled in the art and in particular variants relating to the adjustment of the geometry of the beam. Indeed, the LUT table may conveniently include, in addition to the minimum threshold value mentioned above, one or more additional parameters making it possible to fix the geometry of the beam, and in particular the fact of using a wide or narrow collimation, or even a combination both. It could even advantageously be provided to extract from the LUT table the proportions of distribution of the light power on the three wide, mixed and focusing collimation beams according to the physical activity detected.

Then, in a step 570, the method loops to step 510 to read and process new accelerometer data μx, μy and μz.

As can be seen, the reactive or dynamic light regulation mechanism is advantageously enriched by the contribution of accelerometer data obtained on the fly from the accelerometer 110, and which the control module 220 processes to bring the processed data closer to a predetermined physical activity profile stored in the non-volatile memory 223 which, once identified, makes it possible to consult the LUT table so as to extract the most appropriate parameters and adjustment values for the light regulation.

In this way, the use of the ambient luminosity captured by the sensor 120 can advantageously cooperate with the raw accelerometric data μx, μy and μz generated directly by the 3D accelerometric sensor 110.

Figure 6:
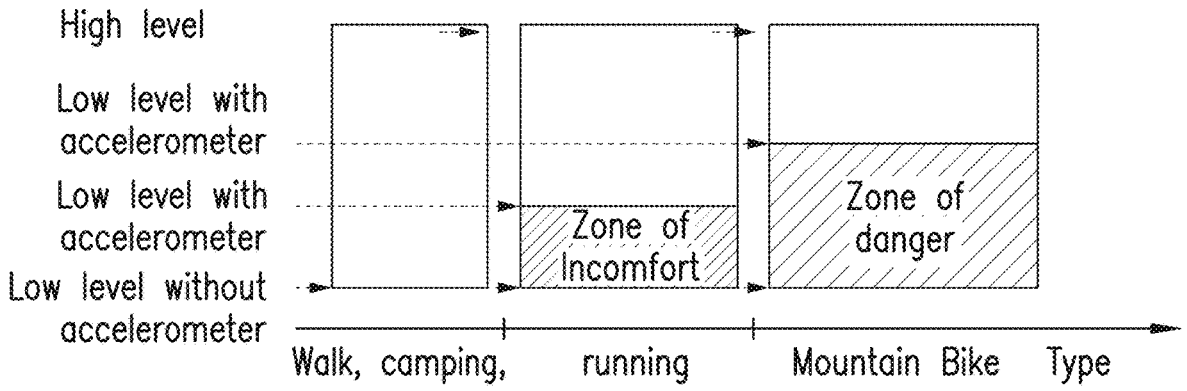
FIG. 6 illustrates the processing of a signal for determining the motion profile of the 3D acceleration sensor

FIG. 6 illustrates the effect of the process which has just been described, where it is seen that the low-level threshold set without the contribution of accelerometry data remains at the same level whatever the activity considered, for example walking (left part of the figure), running (middle part of the figure) and cycling or mountain biking (right part of the figure). If this low level does not pose any difficulty for a walking-type activity, we observe on the other hand that this same low level presents a zone of discomfort for a running activity and even becomes a danger zone for a mountain biking-type activity.

As has just been described, the method described in FIG. 5 makes it possible to automatically increase the low level threshold, to adapt it to a first higher level for a running activity and to raise it to a second level again, higher for a mountain biking type activity, so that the user is never in the discomfort zone represented in the middle part of FIG. 6 and even less in the danger zone of the right part of this same figure.

In the end, therefore, we can see that the method allows a finer adaptation of the light power determined according to a reactive or dynamic regulation method, which takes into account the profile of physical activity considered.

It should be noted that a set of three activity profiles has been described but that the invention could conveniently be used for a higher number of profiles (climbing, alpine skiing, Nordic skiing, etc.)

V. Physical Activity Detection Method

The detection of physical activity is based on a 3D 110 three-dimensional acceleration sensor which comprises three elementary accelerometers:

- a first elementary accelerometer, configured to measure the evolution of a first component of acceleration μx, longitudinal, of the lamp along a first axis (X1) substantially parallel to the direction of movement of the lamp,
- a second elementary accelerometer, configured to measure the evolution of a second component of acceleration μy, vertical, of the lamp along a second axis (Y1) substantially parallel to the local terrestrial vertical direction,
- a third elementary accelerometer, configured to measure the evolution of a third component of acceleration μz, lateral, along a third axis (Z1) perpendicular to the first and second axes.

The X1 and Y1 axes are placed in a sagittal plane with respect to the user.

Each elementary accelerometer is configured to provide a time series of elementary acceleration values along their corresponding axis. The first time series, provided by the first elementary accelerometer, forms a first elementary raw signal, denoted by $S1_b(t, \mu)$, which varies according to time t and the motion profile p of the 3D acceleration sensor relative to the local terrestrial reference. The second time series, provided by the second elementary accelerometer, forms a second elementary raw signal, denoted $S2_b(t, \mu)$, which varies according to time t and the motion profile p of the 3D acceleration sensor relative to the local terrestrial reference. The third time series, provided by the third elementary accelerometer, forms a third elementary raw signal, denoted by $S3_b(t, \mu)$, which varies according to time t and the motion profile p of the 3D acceleration sensor relative to the local terrestrial reference. The motion profile p of the 3D acceleration sensor is for example that of a walker, designated by μ1, that of a cyclist, designated by μ2, or that of a runner, designated by μ3. As illustrated in particular in FIGS. 8*a* to 8*d*.

Figure 7:
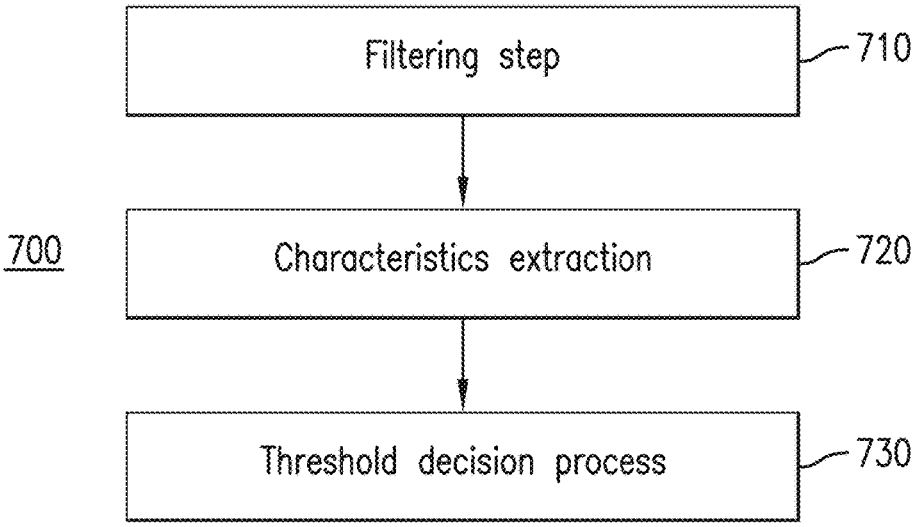
FIG. 7 illustrates the adjustment of the minimum dynamic lighting threshold according to the physical activity detected.

The control module 220 comprises a digital electronic circuit—which could advantageously be produced by means of the processor 221 associated with its memory or by means of any other specialized digital signal processor (DSP) and which is configured to process one or at least two of the raw signals $S1_b(t, \mu)$, $S2_b(t, \mu)$, $S3_b(t, \mu)$ supplied by the 3D acceleration sensor according to a method 700 or algorithm for processing the signal and determining the movement profile of the 3D acceleration sensor illustrated in FIG. 7, and finally allowing the detection of the physical activity useful to the method of FIG. 5.

The method 700 of FIG. 7 includes an initial optional filtering step 710, followed by a feature extraction step 720, then a decision step 730 by thresholding.

In the initial step 710 of the processing method 700, referred to as the "filtering step", one or more of the raw signals $S1_b(t, \mu)$, $S2_b(t, \mu)$, $S3_b(t, \mu)$ are filtered respectively into new signals, called useful signals and denoted by $S1_u(t, \mu)$, $S1_u(t, \mu)$, $S3_u(t, \mu)$, in which useful information is still present but where the non useful information, called "noise" (here electronic noise of the 3D acceleration sensor), is either deleted or weakened. The overall information contained in the signal therefore has a certain degree of specialization at this level. In case the initial filtering step 710 is omitted, the raw signals $S1_b(t, \mu)$, $S2_b(t, \mu)$, $S3_b(t, \mu)$ are respectively identical to the useful signals $S1_u(t, \mu)$, $S2_u(t, \mu)$, $S3_u(t, \mu)$ According to FIGS. 8A, 8B, 8C and 8D the useful signals of the triplet $S1_u(t, \mu0)$, $S1_u(t, \mu0)$ et $S3_u(t, \mu0)$, are illustrated respectively for different motion profiles μ0, μ1, μ2 and μ3 of the 3D acceleration sensor 110.

Figure 8A:
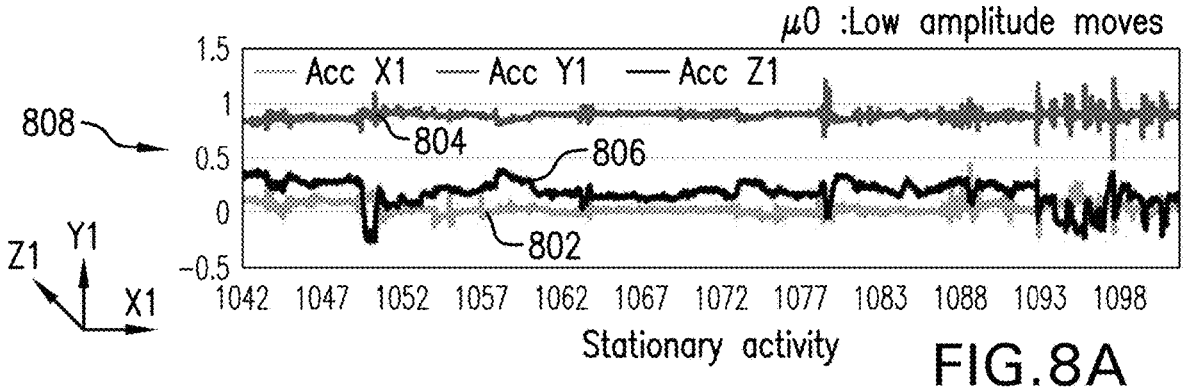
FIGS. 8A, 8B, 8C and 8D respectively illustrate the useful signals of the triplet ($S1_{\mu}(t, \mu)$, $S2_{\mu}(t, \mu)$, $S3_{\mu}(t, \mu)$) for different profiles of movements μ0,μ1,μ2 et μ3 of the 3D acceleration sensor 110.

According to FIG. 8A, the useful signals $S1_u(t, \mu0)$, $S1_u(t, \mu0)$ and $S3_u(t, \mu0)$, respectively illustrated on a first curve 802, a second curve 804, a third curve 806, are typically those of a 3D acceleration sensor having the form 808 of a reference movement profile μ0, corresponding to a movement of low amplitude or almost zero of the 3D acceleration sensor.

Figure 8B:
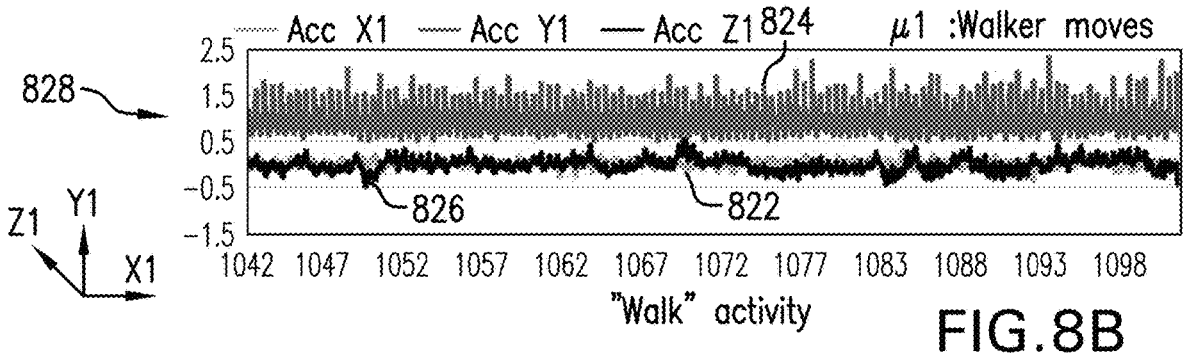

According to FIG. 8B, the useful signals $S1_u(t, \mu1)$, $S1_u(t, \mu1)$ and $S3_u(t, \mu1)$, respectively illustrated on a fourth curve 822, a fifth curve 824 and a sixth curve 826 are typically those of a 3D acceleration sensor having the form 828 of a motion profile μ1 of a walker.

Figure 8C:
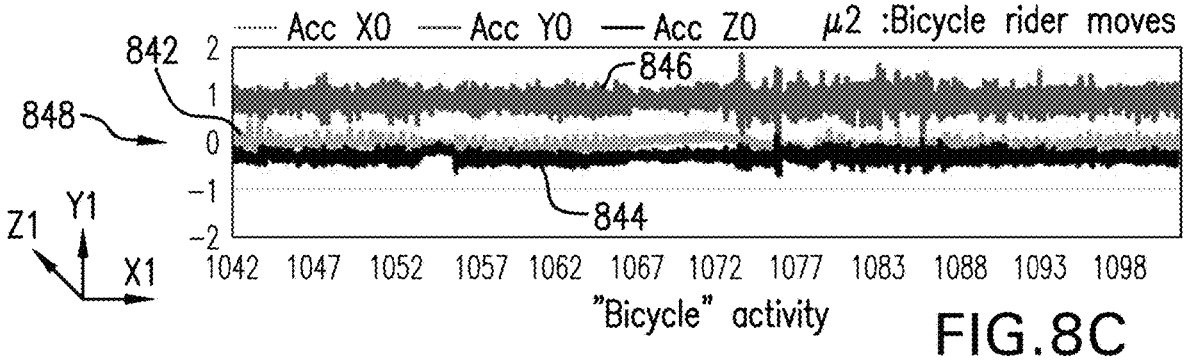

According to FIG. 8C, the useful signals $S1_u(t, \mu2)$, $S1_u(t, \mu2)$ and $S3_u(t, \mu2)$, respectively illustrated on a seventh curve 842, an eighth curve 844 and a ninth curve 846 are typically those of a 3D acceleration sensor having the form 848 of a motion profile μ2 of a cyclist ("biking").

Figure 8D:
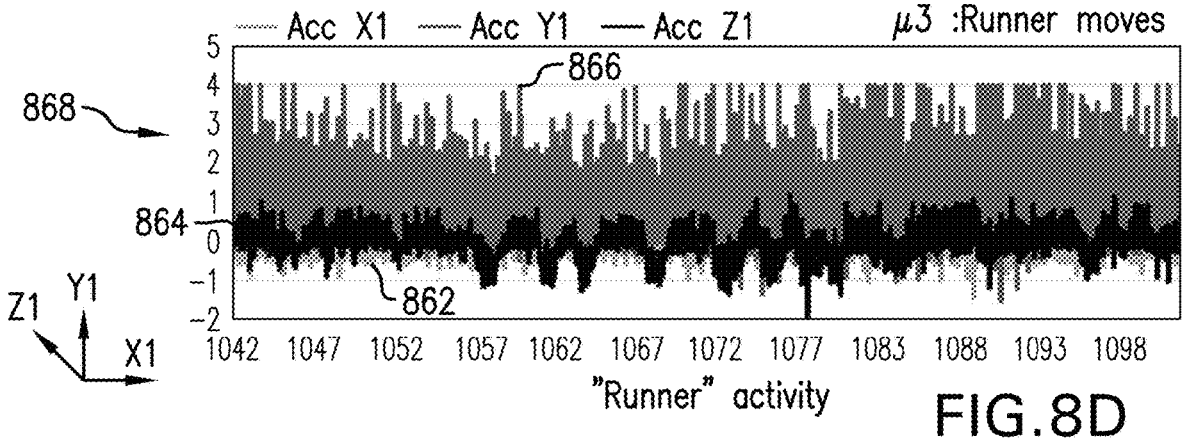

According to FIG. 8D, the useful signals $S1_u(t, \mu3)$, $S1_u(t, \mu3)$ and $S3_u(t, \mu3)$, respectively illustrated on a tenth curve 862, an eleventh curve 864 and a twelfth curve 866 are typically those of a 3D acceleration sensor having the form 868 of a motion profile μ3 of a runner (in English "jogging").

The object of the characteristics extraction step 720 is to extract from at least one of the useful signals $S1_u(t, \mu)$, $S1_u(t, \mu)$, $S3_u(t, \mu)$ a finite set of several parameters, if possible independent, representative of the observed phenomenon, and allowing it to be described.

The extraction of characteristics implemented in step 720 allows in other words the passage of a useful vector or scalar signal to data. The difference between these two types is important: a signal can be seen as a set of points for which each point has a high degree of dependence (deterministic or statistical) with its neighbors. Data represent a set of points where this notion of neighborhood is less important. In reality, the transition from signal to data most often takes place in several stages. The intermediate entities then carry either the name of signal, estimator, or data. The main goal of feature extraction is to obtain, from the useful signal, data that is independent of each other and exhaustively represents the phenomenon to be interpreted.

In general, the useful signals studied here can be characterized by elementary estimators which are the moments of these signals: the mean (moment of order 1), and the pseudo-standard deviation (moment of order 2) are the better known and more widely used. For example, an estimator can be a function of one or more moments of the same useful signal.

According to a first embodiment, the useful signal $S2_u(t, \mu)$ which measures the evolution of the second vertical acceleration component of the lamp can characterize on its own the movement profile of the lamp from its moment of order 2, that is to say its variance. According to the first embodiment, the estimator making it possible to characterize the movement profile of the lamp is written over a current and sliding sampling window of predetermined duration $T_{est}$ by the following equation:

$$Est(S2)(\mu) = \sum_{k=1 \grave{a} Nech} (S2(tk, \mu) - mS2)^2 / Nech$$

in which:

Nech designates the total number of equally distributed sampling instants in the current sampling window, mS2 designates the statistical average of the useful signal S2 calculated in the current sampling window calculated from the measurements of useful signal S2 at the same sampling instants tk.

Here the elementary estimator considered Est(S2) is the statistical variance of the useful signal $S2_u(t, \mu)$.

Then, in the decision step 730 by thresholding, the type of movement profile of the lamp is determined by thresholding on the estimator Est(S2)(μ).

These elementary estimators taken in isolation may not always be sufficient to provide a good description of a complex problem. In order to systematically choose estimators that are consistent and useful for the interpretation of a signal, more sophisticated analysis methods may prove useful.

For complex problems, the efficient extraction of features is very often reduced by statisticians to the determination of the dimension of the problem. This dimension is given by the minimal number of parameters allowing to represent the problem in an exhaustive way. These parameters are then called problem variables. By definition these variables are variables are independent of each other, this decreases the dimension of the problem by 1. In practice, for complex problems, it is very difficult to construct the vector of variables. Indeed, it is rare that the estimators that we know how to extract from a signal are totally independent of each other. Moreover, the construction of these estimators requires a "perfect" mathematical model of the problem (in the sense of physics), which is not always possible. A certain number of analysis methods make it possible to extract, to construct a vector of parameters from any vector. These methods are grouped under the generic term of factor analysis.

Factor analysis proceeds from a geometric reasoning on the data. We consider the signal as a "cloud of points" in an N-dimensional space, and we seek to determine the geometric characteristics of this cloud: main axes (eigenvectors), spreading, form factors, etc. For this, the approach is to calculate the eigenvectors of the point cloud, then to change space, so as to express the coordinates of the points of the cloud, as well as all the relations known on these points, in the space of the eigenvectors. Among the statistical methods of factor analysis are:

principal component analysis, factorial analysis of correspondences, factorial analysis of multiple correspondents discriminant factor analysis, linear regression, the classification by k-means (in English k-means), characterization by fractal geometry.

For example, according to a second embodiment, the dimension of the problem of estimating the movement profile of the lamp is considered equal to 3. The three elementary variables are formed by the respective statistical variances Est(S1)(μ), Est(S2)(μ), Est(S3)(μ), of useful signals $S1_u(t, \mu)$, $S2_u(t, \mu)$, $S3_u(t, \mu)$. A scalar estimator denoted Est(S1, S2, S3)(μ) of the useful vector signal ($S1_u(t, \mu)$, $S2_u(t, \mu)$, $S3_u(t, \mu)$) is determined as a linear combination of the statistical variances Est(S1)(μ), Est(S2)(μ), Est(S3)(μ) according to the equation:

$$Est(S1,S2,S3)(\mu)=a*Est(S1)(\mu)+b*Est(S2)(\mu)+c*Est(Sc)(\mu)$$

in which the parameters a, b, c are determined by learning on the useful learning signals $\{S1_u(t, \mu0), S2_u(t, \mu0), S3_u(t, \mu0)\}$, $\{S1_u(t, \mu1), S2_u(t, \mu1), S3_u(t, \mu1)\}$, $\{S1_u(t, \mu2), S2_u(t, \mu2), S3_u(t, \mu2)\}$, et $\{S1_u(t, \mu3), S2_u(t, \mu3)$ et $S3_u(t, \mu3)$.

Then, in the decision step 730 by thresholding, the type of movement profile of the lamp is determined by thresholding on the scalar estimator Est(S1, S2, S3)(μ).

It should be noted that these more complex realizations, resorting to the combination of several variables, make the detection process more robust, in particular with regard to a possible rotation of the user's head with respect to one of the axes.

VI. Additional Improvements and Advantages of the Invention

In a preferred embodiment, the physical activity profile identified by the control module 220 is transmitted by the wireless link to the mobile telephone 300 so that the latter can inform, at any time, of the physical activity detected automatically according to the above technique to, if necessary, allow the user to come and correct the detection and allow adaptive learning of the physical activity detection method.

Furthermore, in a particular embodiment, the headlamp is configured to read accelerometer data μx, μy and μz on the fly to determine the fall of the user and, in this case, to trigger a procedure of emergency. In particular, the procedure may be based on the sending of an alert signal to the mobile telephone so as to initiate the generation of an emergency message, of the SMS or email type.

Alternatively, or cumulatively, the alert procedure will include the activation of the lamp for the generation of an alert light sequence, such as for example a MORSE coding of the well-known sequence S.O.S.

Any other alert procedure may be considered once the headlamp control module 220 has detected the fall of the user.

Finally, it is useful to note that the invention is not limited to headlamps alone and can be used applied to a hand lamp.

What is claimed is:

1. A lamp comprising:

a light source comprising one or more LED-type diodes;

a power module for supplying current to said light source, said power module being controlled by a control information or a control signal;

a control module for adjusting the light intensity generated by said light source; said control module comprising:

a light sensor for sensing light from an environment of the lamp, said control module being configured to generate said control information or said control signal according to the information generated by said light sensor, wherein said control module further comprises:

an accelerometer configured to provide at regular intervals data representative of an acceleration of the lamp along at least one horizontal axis and one vertical axis;

wherein said control module includes circuitry configured to digitally store and process data representative of said acceleration and to determine a physical activity profile selected from a set of predetermined physical activity profiles stored within a memory;

wherein said control module comprises a LUT look-up table stored within said memory providing at least one value or parameter serving for generating said control information or said control signal;

wherein the physical activity profile selected by said circuit serves as an entry pointer into said LUT;

wherein the value or parameter read from said LUT is used in conjunction with information generated by the light sensor to determine said control information or said control signal.

2. The lamp according to claim 1 characterized in that said accelerometer generates accelerometer data along two horizontal axes X1, Z1 and along a vertical axis Y1; and wherein the set of predetermined physical activity profiles include profiles representative of walking, running and cycling.

3. The lamp according to claim 1 characterized in that the power of the light beam adjusted by the control module varies between two thresholds, respectively low and high, and wherein said low threshold is set by a value extracted directly from said LUT table.

4. The lamp according to claim 1 characterized in that said circuit configured to store and process data representative of said acceleration uses a digital and statistical processing method based on the measurement of the variance of the component of vertical acceleration μy of said lamp.

5. The lamp according to claim 4 characterized in that said circuit configured to store and process data representative of said acceleration uses a digital and statistical processing method based on the measurement of the variance of two components of acceleration of said lamp.

6. The lamp according to claim 1 characterized in that the data extracted from the LUT table make it possible to define a minimum light power threshold and a specific geometry of the light beam chosen between a wide beam, a narrow focusing beam and/or both.

7. The lamp according to claim 1 characterized in that said lamp is a headlamp and in that said control module is configured to process data from the accelerometer to detect the fall of a user.

8. The lamp according to claim 7 wherein said control module transmits the user fall information in order to generate an electronic alert transmitted to the mobile phone.

9. The lamp according to claim 8 wherein the control module is configured to control a light alert sequence aimed at calling for help.

10. A light regulation method for a lamp as defined in claim 1, comprising the steps of:

generating at regular intervals a set of accelerometer data μx, μy and μy provided by said accelerometer;

storing said data μx, μy and μz within a random-access memory;

performing digital processing on said accelerometer data μx, μy and μz in order to determine a physical activity profile selected from a set of N predetermined profiles stored in a non-volatile memory;

using the selected profile as an input pointer to access a LUT correspondence table in which are stored values and parameters specific to the mechanism allowing the generation of said control information or said control signal used to adjust the light power;

reading the LUT correspondence table and extracting the parameter(s) or values stored therein;

determining said control information or said control signal from the value or values extracted from the LUT correspondence table, together with the information provided by said light sensor;

return to the first step to read and process new accelerometer data.

11. The method according to claim 10, characterized in that the reading of the LUT correspondence table provides a value defining the minimum light power generated by the lamp.

* * * * *